US006452321B1

(12) United States Patent
Kojima

(10) Patent No.: US 6,452,321 B1
(45) **Date of Patent: *Sep. 17, 2002**

(54) DEFLECTION DEVICE FOR A CATHODE RAY TUBE HAVING A CORRECTION COIL WITH A NON-CIRCULAR SHAPE

(75) Inventor: Tadahiro Kojima, Fukaya (JP)

(73) Assignee: Kabushiki Kaisha Toshiba, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/324,118

(22) Filed: Jun. 2, 1999

(30) Foreign Application Priority Data

Jun. 3, 1998 (JP) ..... 10-154636

(51) Int. Cl.[7] ..... H01J 29/70

(52) U.S. Cl. ..... 313/440; 313/421; 313/413; 335/213; 335/214; 315/8

(58) Field of Search ..... 313/440, 421, 313/413, 409; 335/210, 211, 212, 213, 214; 315/8

(56) References Cited

U.S. PATENT DOCUMENTS

| | | | | |
|---|---|---|---|---|
| 3,731,129 A | | 5/1973 | Tsuneta et al. | 313/64 |
| 3,806,750 A | * | 4/1974 | Tsuneta et al. | 313/364 |
| 5,225,736 A | * | 7/1993 | Fujiwara et al. | 313/440 |
| 5,521,463 A | * | 5/1996 | Ogawa et al. | 313/440 |
| 5,763,995 A | | 6/1998 | Sano et al. | 313/477 |

* cited by examiner

*Primary Examiner*—Vip Patel
*Assistant Examiner*—Kevin Quarterman
(74) *Attorney, Agent, or Firm*—Pillsbury Winthrop LLP

(57) ABSTRACT

A vacuum envelope of a cathode ray tube includes a face panel having a phosphor screen formed on the inner surface, a funnel joined to the face panel and having a yoke-mounting section, and an electron gun for emitting electron beams toward the phosphor screen. A deflection yoke mounted on the yoke-mounting section of the funnel has a first open end portion positioned on the side of the phosphor screen, and a correcting coil for correcting the positional deviation of the displayed image in a rotating direction is arranged at the first open end portion. The correcting coil is formed substantially rectangular to conform with the cross sectional shape of each of the yoke-mounting section and deflection coils of the deflection yoke.

8 Claims, 3 Drawing Sheets

DEFLECTION DEVICE FOR A CATHODE RAY TUBE HAVING A CORRECTION COIL WITH A NON-CIRCULAR SHAPE

BACKGROUND OF THE INVENTION

The present invention relates to a cathode ray tube apparatus used in a monitor of an electronic computer or a television receiver and to a deflection device for a cathode ray tube.

In general, a cathode ray tube apparatus comprises a cathode ray tube and a truncated cone-shaped deflection device mounted on the cathode ray tube. The cathode ray tube comprises a vacuum envelope having a face panel and a funnel. A phosphor screen is formed on the inner surface of the face panel, and an electron gun is arranged within the funnel. On the other hand, the deflection device comprises deflection coils mounted on the outer circumferential surface of the funnel for deflecting the electron beams emitted from the electron gun in the horizontal and vertical directions, respectively, a core arranged in the vicinity of the deflection coils, and a correcting coil for rotating the displayed picture image about the tube axis.

In the cathode ray tube apparatus of the particular construction, a positional deviation in the rotating direction about the tube axis tends to take place when the deflection device is assembled on the vacuum envelope of the cathode ray tube. In order to correct the positional deviation in the rotating direction, the deflection device is provided with the correcting coil such as a rotation coil, a tilt coil or a Z coil, and a DC current is allowed to flow through the correcting coil so as to correct the positional deviation in the rotating direction.

In general, the correcting coil is arranged in an open end portion of the deflecting device on the side of a phosphor screen. In addition to the deflection of the electron beams performed by the vertical and horizontal deflection coils of the deflection device, an auxiliary deflection of the electron beams is performed by the magnetic field produced by the correcting coil so as to correct the positional deviation of the displayed image about the tube axis. Of course, it is desirable for the correcting coil to be arranged as close to the tube axis as possible.

In the conventional cathode ray tube apparatus, the correcting coil is shaped substantially circular like the cross sectional shape of the deflection device-mounting portion of the funnel and the cross sectional shape of the open end portion of the deflection device on the side of the phosphor screen.

However, in recent years, the cross section of the yoke-mounting portion of the vacuum envelope of the cathode ray tube is not limited to a circular cross section, and the cross section is also shaped rectangular or elliptical. In this connection, the horizontal and vertical coils of the deflection device and the core are also shaped to have a rectangular or elliptical cross section.

Where a conventional correcting coil having a circular cross section is used in such a cathode ray tube apparatus, it is difficult to arrange the correcting coil close to the tube axis of the cathode ray tube. It follows that it is difficult for the correcting coil to correct efficiently a positional deviation of the displayed image.

BRIEF SUMMARY OF THE INVENTION

The present invention has been contrived in consideration of the above described circumstances and its object is to provide a cathode ray tube apparatus that permits efficiently correcting a positional deviation of the displayed image in the rotating direction about the tube axis to obtain desired displayed image characteristics and to provide a deflecting device for a cathode ray tube.

According to an aspect of the present invention, there is provided a cathode ray tube apparatus, comprising:

a cathode ray tube including an envelope having a face panel on an inner surface of which a phosphor screen is formed and a funnel joined to the face panel, and an electron gun arranged within a neck of the funnel for emitting electron beams toward the phosphor screen; and a substantially funnel-shaped deflection device having a first open end on the side of the phosphor screen and a second open end on the side of the neck and mounted on the outer circumferential surface of a deflection device-mounting section of the funnel.

The deflection device includes a substantially funnel-shaped core, a plurality of deflection coils for deflecting the electron beams in the horizontal and vertical directions, and a correcting coil provided at the first open end for rotating a displayed image about the tube axis. The correcting coil is shaped non-circular, which is substantially equal to the shape of the first open end of the deflection device.

In the present invention, the deflection device-mounting section of the funnel has a substantially rectangular cross section. Also, the first open end of the deflection device and the correcting coil are shaped substantially rectangular to conform with the cross section of the deflection device-mounting section.

Moreover, according to the present invention, the deflection device-mounting section of the funnel has a substantially elliptical cross section. Also, the first open end of the deflection device and the correcting coil are shaped substantially elliptical to conform with the cross section of the deflection device-mounting section.

Further, the deflection device-mounting section of the funnel has a substantially rectangular cross section and the first open end of the deflection device is shaped substantially rectangular to conform with the cross section of the deflection device-mounting section. On the other hand, the correcting coil is shaped elliptical.

According to another aspect of the present invention, there is provided a deflection device for a cathode ray tube, comprising:

a substantially funnel-shaped core having a first open end portion positioned on the side of a phosphor screen of the cathode ray tube and a second open end portion positioned on the side of a neck of the cathode ray tube;

a plurality of deflection coils for deflecting electron beams in horizontal and vertical directions; and a correcting coil provided at the first open end portion of the core for rotating a displayed image about a tube axis of the cathode ray tube;

wherein the correcting coil is formed non-circular to conform substantially with the first open end portion of the deflection device.

In the deflection device for a cathode ray tube according to the present invention, each of the first open end portion and the correcting coil is formed substantially rectangular or substantially elliptical.

As described above, in each of the cathode ray tube apparatus and the deflection device of the present invention, the correcting coil arranged at the first open end portion for rotating the displayed image about the tube axis is shaped substantially equal to the cross sectional shape of the first open end portion or the deflection device-mounting section of the funnel, making it possible to have the correcting coil positioned close to the tube axis, or the electron beams. It follows that it is possible to correct efficiently the positional deviation of the displayed image by the magnetic field generated from the correcting coil so as to obtain desired displayed image characteristics.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

A cathode ray tube apparatus according to an embodiment of the present invention will now be described in detail with reference to the accompanying drawings.

Figure 1:
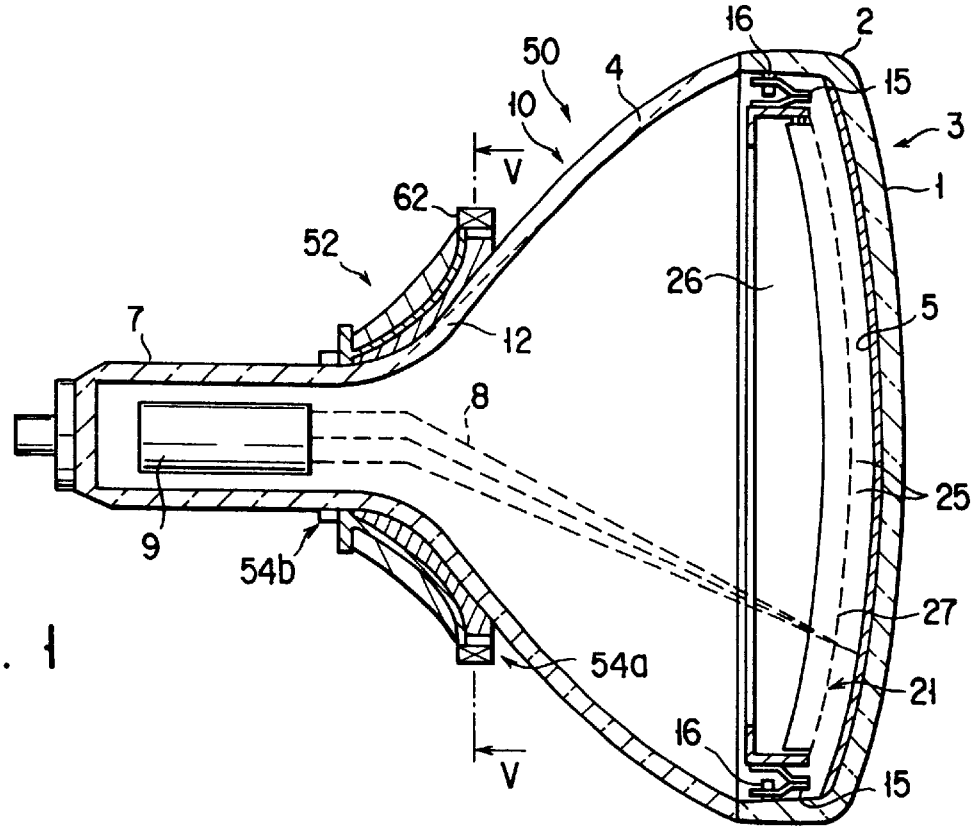
FIG. 1 is a cross sectional view showing a cathode ray tube apparatus according to an embodiment of the present invention.
Figure 2:
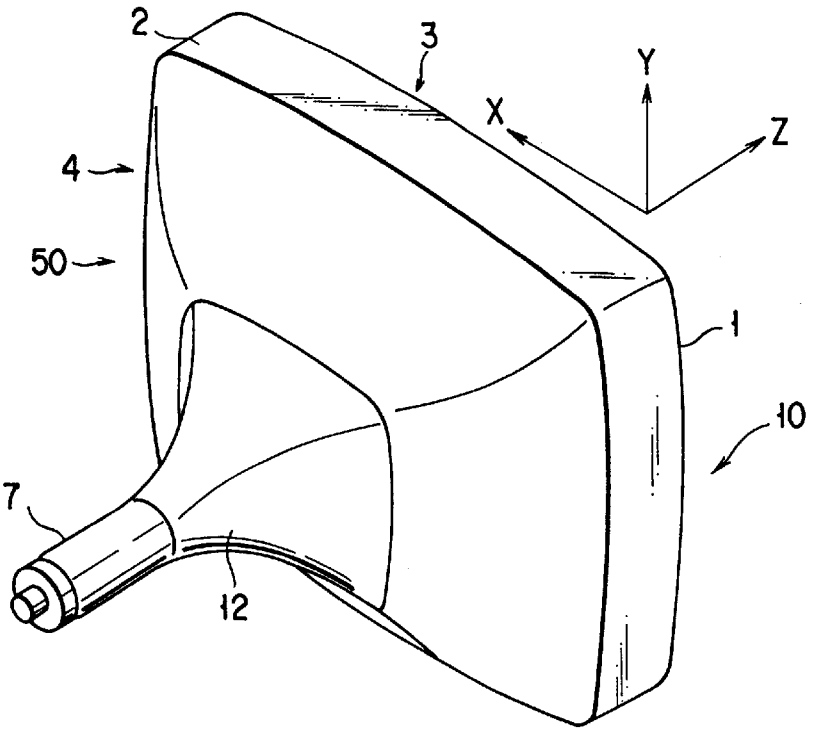
FIG. 2 is a perspective view showing the vacuum envelope of the cathode ray tube apparatus as viewed from the back side.
Figure 3:
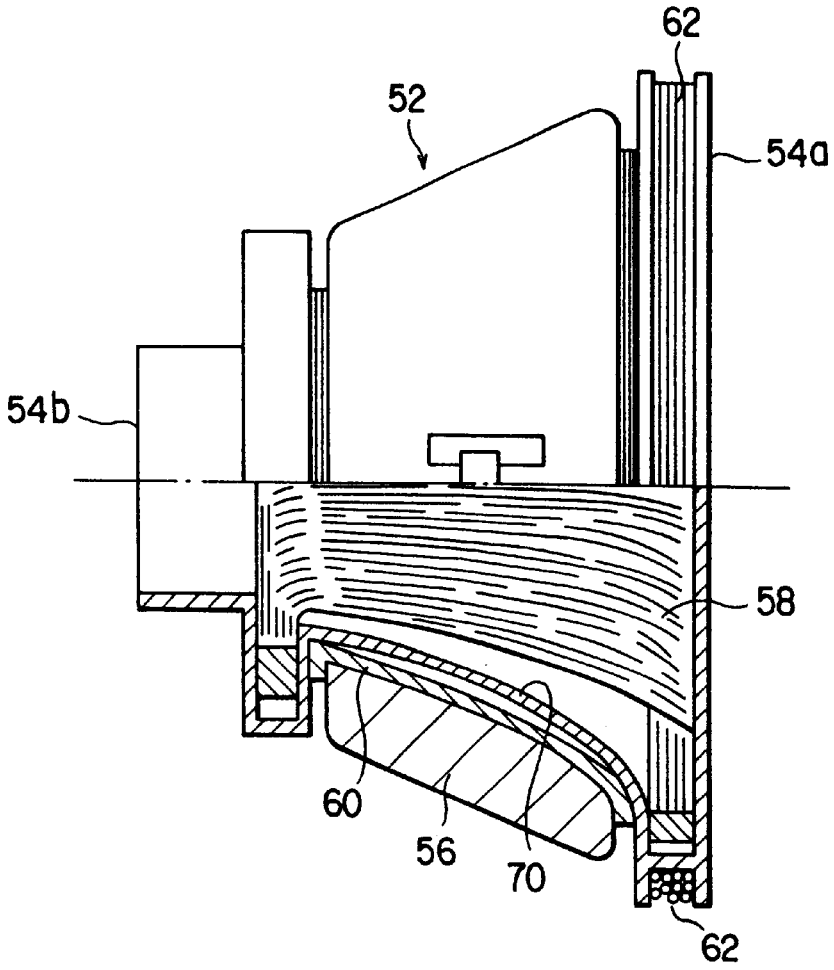
FIG. 3 is a side view, partly broken away, showing a deflection yoke of the cathode ray tube apparatus.
Figure 4:
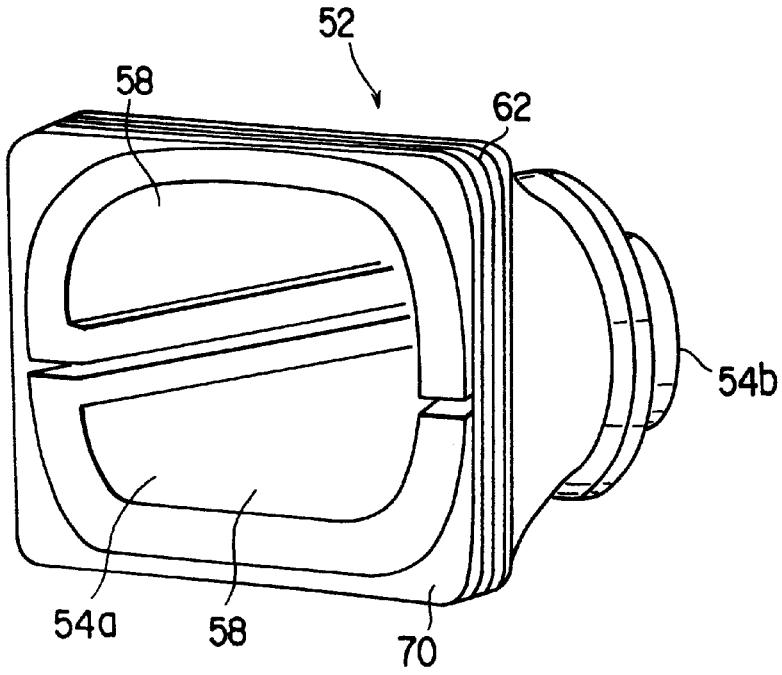
FIG. 4 is a perspective view showing the deflection yoke.

As shown in FIGS. 1 and 2, the cathode ray tube apparatus comprises a cathode ray tube 50 and a deflection yoke 52 mounted to the cathode ray tube as a deflection device. The cathode ray tube 50 comprises a vacuum envelope 10 made of glass. The vacuum envelope 10 includes a face panel 3 having a substantially rectangular effective portion 1 and a skirt portion 2 formed on the peripheral portion of the effective portion 1, a funnel 4 joined to the skirt portion 2, and a cylindrical neck 7 projecting from the funnel 4. The effective portion 1 of the face panel 3 is formed substantially rectangular to have a horizontal axis X and a vertical axis Y both passing through a tube axis Z of the cathode ray tube and crossing at right angles. The funnel 4 includes a yoke-mounting section 12 extending from the neck 7 toward the face panel 1. The deflection yoke 52 is mounted on the outside of the yoke-mounting section 12.

On the inner surface of the effective portion 1 of the face panel is formed a phosphor screen 5 having stripe-like or dot-like three color phosphor layers emitting blue, green and red light and light-shielding layers interposed between adjacent phosphor layers. Also, a shadow mask 21 is arranged within the vacuum envelope 10 to face the phosphor screen 5.

The shadow mask 21 includes a mask body 27 provided with a large number of electron beam-passage apertures 25 and a mask frame 26 supporting the periphery of the mask body. Also, substantially wedge-shaped elastic support members 15 fixed to side wall portions of the mask frame 26 are engaged with respective stud pins 16 projecting from the inner surface of the skirt portion 2 of the face panel 3 so as to allow the shadow mask 21 to be supported by the face panel 3.

An electron gun 9 for emitting electron beams 8 is arranged within the neck 7. Three electron beams 8 emitted from the electron gun 9 run through the shadow mask 5 to reach the phosphor screen 5. Since these electron beams are deflected by horizontal and vertical magnetic fields generated from the deflection yoke 52, the phosphor screen 5 is scanned by the electron beams in horizontal and vertical directions so as to display a color picture image.

The yoke-mounting section 12 of the funnel 4 on which the deflection yoke 52 is mounted is formed in a substantially pyramidal shape, as shown in FIG. 2. To be more specific, the cross section of the yoke-mounting section 12 in a plane perpendicular to the tube axis Z is circular in the vicinity of the connecting portion to the neck 7 like the cross section of the neck 7 and is substantially rectangular in a central portion and in the vicinity of the edge portion on the side of the phosphor screen to conform with the shape of the effective portion 1 of the face panel.

On the other hand, the deflection yoke 52 mounted on the yoke-mounting section 12 is substantially in the shape of a truncated pyramid to conform with the yoke-mounting section and has a first open end portion 54*a* positioned on the side of the phosphor screen 5 and a second open end portion 54*b* positioned on the side of the neck 7, as shown in FIGS. 1 to 3 and 5.

The deflection yoke 52 includes a core 56 substantially in the shape of a truncated pyramid. The first open end portion of the core 56 positioned on the side of the phosphor screen 5 is shaped substantially rectangular to conform with the cross sectional shape of the yoke-mounting section 12, and the second open end portion of the core on the side of the neck 7 is shaped circular.

The deflection yoke 52 includes a pair of horizontal deflection coils 58 generating a magnetic field for horizontally deflecting the electron beams emitted from the electron gun 7 and a pair of vertical deflection coils 60 generating a magnetic field for vertically deflecting the electron beams. The horizontal deflection coils 58 and the vertical deflection coils 60 are separated from each other by a separator 70 and arranged along the inner surface of the core 56. It follows that each of the horizontal and vertical deflection coils 58 and 60 has a substantially rectangular cross section on the side of the first open end portion 54*a* and a substantially circular cross section on the side of the second open end portion 54*b*. The horizontal deflection coils 58 consist of a pair of upper and lower saddle-shaped deflection coils, for example. Also, the vertical deflection coils 60 consist of a pair of right and left saddle-shaped deflection coils, for example.

Figure 5:
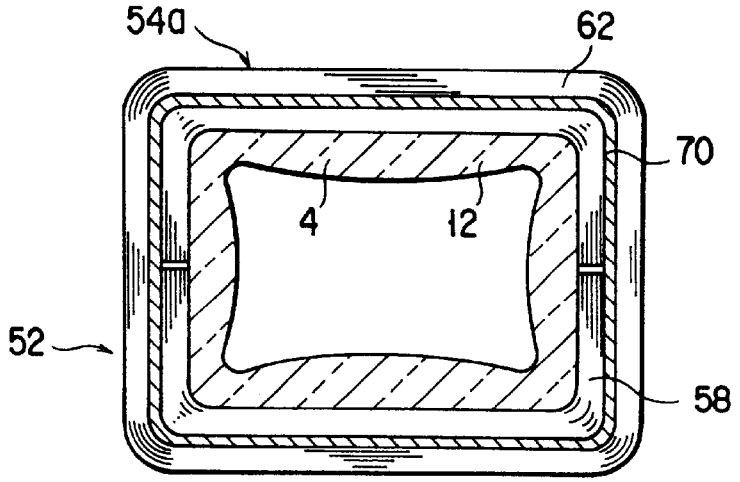
FIG. 5 is a cross sectional view taken along the line V—V in FIG. 1.

The deflection yoke 52 also includes a correcting coil 62 generating a magnetic field for correcting the positional deviation of the displayed image in the rotating direction about the path of the electron beams, or the tube axis Z. The correcting coil 62 is wound about the outer circumferential surface of the separator 70 in the first open end portion 54*a* on the side of the phosphor screen 5 and is shaped rectangular to conform with the cross section of the yoke-mounting section 12 as shown in FIG. 5.

With the cathode ray tube apparatus constructed as described above, the correcting coil 62 for rotating the displayed image about the tube axis Z is substantially rectangular to conform with the cross sectional shape of the yoke-mounting section 12 of the funnel 4 and with the cross sectional shape of each of the horizontal and vertical deflection coils 58 and 60. The particular construction permits arranging the entire correcting coil 62 as close to the electron beams as possible, making it possible for the correcting coil to correct efficiently the positional deviation of the displayed image in the rotating direction. It follows that a cathode ray tube apparatus exhibiting good displayed image characteristics can be obtained.

Figure 6:
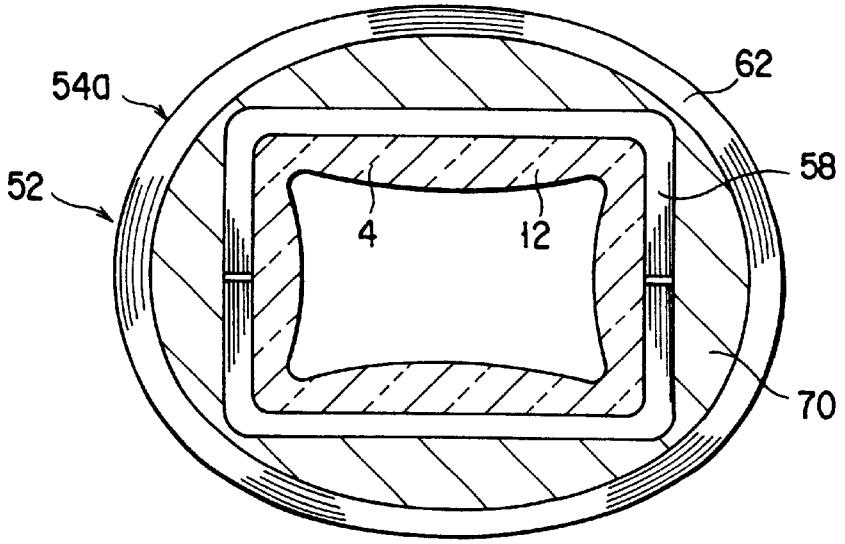
FIG. 6 is a cross sectional view corresponding to FIG. 5 and showing a deflection yoke and a funnel according to another embodiment of the present invention.
Figure 7:
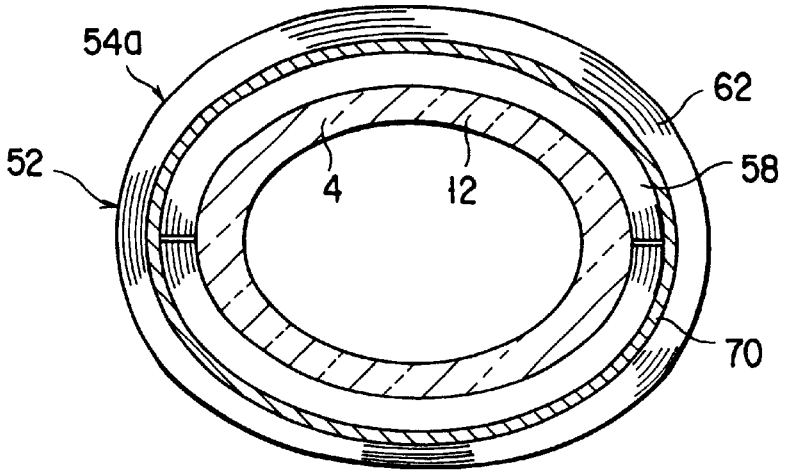
FIG. 7 is a cross sectional view corresponding to FIG. 5 and showing a deflection yoke and a funnel according to still another embodiment of the present invention.

The present invention is not limited to the embodiment described above and can be modified in various fashions within the technical scope of the present invention. For example, in the embodiment described above, the correcting coil 62 is shaped rectangular to conform with the cross sectional shape of the yoke-mounting section 12. However, the correcting coil may be shaped non-circular, e.g., elliptical, as shown in FIG. 6. Also, the cross section of the yoke-mounting section 12 is not limited to a rectangular cross section. For example, the cross section of the yoke-mounting section 12 may be elliptical as shown in FIG. 7. In this case, the correcting coil 62 is shaped non-circular, e.g., elliptical, to conform with the yoke-mounting section facing the correcting coil 12. In each of these modifications, it is possible to obtain the function and effect similar to those obtained in the embodiment described above.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cathode ray tube apparatus comprising:

a cathode ray tube including an envelope having a face panel on an inner surface of which a phosphor screen is formed and a funnel joined to the face panel, and an electron gun arranged with a neck of the funnel for emitting electron beams toward the phosphor screen, the funnel having a deflection device-mounting section with a non-circular cross section and a cathode ray tube having a tube axis; and a substantially funnel-shaped deflection device having a first open end on the side of the phosphor screen and a second open end on the side of the neck and mounted on an outer circumferential surface of the deflection device-mounting section of the funnel, wherein the deflection device includes a substantially funnel-shaped core, a plurality of deflection coils for deflecting the electron beams in the horizontal and vertical directions, and a correcting coil for rotating a displayed image about the tube axis, and the whole correcting coil is disposed coplanar with the first open end of the deflection device, is wound about the outer circumference of the first open end of the deflection device and is shaped non-circular and substantially equal in shape to the first open end of the deflection device.

2. A cathode ray tube apparatus according to claim 1, wherein the deflection device-mounting section has a substantially rectangular cross section, and the first open end portion of the deflection device and the correcting coil are formed substantially rectangular to conform with the cross sectional shape of the deflection device-mounting section.

3. A cathode ray tube apparatus according to claim 1, wherein the deflection device-mounting section of the funnel has a substantially elliptical cross section and each of the first open end portion of the deflection device and the correcting coil are formed substantially elliptical to conform with the cross sectional shape of the deflection device-mounting section.

4. A cathode ray tube apparatus according to claim 1, wherein the deflection device-mounting section of the funnel has a substantially rectangular cross section and each of the first open end portion of the deflection device is formed substantially rectangular to conform with the cross sectional shape of the deflection device-mounting section, and the correcting coil is shaped elliptical.

5. A substantially funnel-shaped deflection device constructed to be mounted on a deflection device-mounted section of a cathode ray tube including a tube axis, a face panel having a phosphor screen formed on an inner surface of the face panel, a funnel joined to the face panel and having the deflection device-mounting section with a non-circular cross section, and an electron gun arranged within a neck of the funnel for emitting electron beams toward the phosphor screen, the deflection device comprising:

a first open end portion which is to be positioned on the side of the phosphor screen and a second open end portion which is to be positioned on the side of the neck;

a substantially funnel-shaped core;

a plurality of deflection coils for deflecting the electron beams in horizontal and vertical directions; and a correcting coil disposed coplanar with the first open end portion for rotating a displayed image about the tube axis, the whole correcting coil being wound about the outer circumference of the first open end of the deflection device and having a non-circular shape to conform substantially with the shape of the first open end portion of the deflection device.

6. A deflection coil according to claim 5, wherein each of the first open end portion of the deflection device and the correcting coil is formed substantially rectangular.

7. A deflection coil according to claim 5, wherein each of the first open end portion of the deflection device and the correcting coil is formed substantially elliptical.

8. A deflection coil according to claim 5, wherein the first open end portion of the deflection device is formed substantially rectangular and the correcting coil is formed substantially elliptical.

* * * * *